US011167960B2

(12) United States Patent
Zhang et al.

(10) Patent No.: US 11,167,960 B2
(45) Date of Patent: Nov. 9, 2021

(54) GANTRY CRANE FOR CONTAINER

(71) Applicant: SOUTHWEST JIAOTONG UNIVERSITY, Sichuan (CN)

(72) Inventors: Zeqiang Zhang, Sichuan (CN); Peiyu Xu, Sichuan (CN); Silu Liu, Sichuan (CN); Mengke Xie, Sichuan (CN); Yu Zhang, Sichuan (CN); Feng Chen, Sichuan (CN)

(73) Assignee: SOUTHWEST JIAOTONG UNIVERSITY, Chengdu (CN)

( * ) Notice: Subject to any disclaimer, the term of this patent is extended or adjusted under 35 U.S.C. 154(b) by 0 days.

(21) Appl. No.: 17/338,473

(22) Filed: Jun. 3, 2021

(65) Prior Publication Data

US 2021/0292133 A1 Sep. 23, 2021

(30) Foreign Application Priority Data

Jun. 4, 2020 (CN) ..... 202010501973.9

(51) Int. Cl.

*B66C 19/00* (2006.01)
*B66C 1/42* (2006.01)
*B66C 1/10* (2006.01)

(52) U.S. Cl.

CPC ..... *B66C 19/007* (2013.01); *B66C 1/101* (2013.01); *B66C 1/425* (2013.01); *B66C 2700/01* (2013.01)

(58) Field of Classification Search

CPC ..... B66C 19/00; B66C 19/007; B66C 1/101; B66C 1/425; B66C 2700/00; B66C 2700/01

See application file for complete search history.

(56) References Cited

U.S. PATENT DOCUMENTS 4,216,987 A 8/1980 Ely
5,449,268 A 9/1995 Lingo et al.
5,769,589 A * 6/1998 Lubbers ..... B65G 63/004 414/268
7,665,784 B2 * 2/2010 Stinis ..... B66C 1/663 294/81.21

(Continued)

FOREIGN PATENT DOCUMENTS

CN 206915559 U 1/2018
CN 108975152 A 12/2018

(Continued)

*Primary Examiner* — Michael R Mansen
*Assistant Examiner* — Juan J Campos, Jr.
(74) *Attorney, Agent, or Firm* — Wayne IP LLC

(57) ABSTRACT

A gantry crane for a container includes a portal main frame, a traveling mechanism, a translation mechanism, a hoisting mechanism and a spreader assembly. The spreader assembly includes a spreader body, two telescopic girders and a drive assembly. The drive assembly includes a cam, a sliding way and two sliding blocks. Two arc-shaped first sliding grooves are circumferentially provided on the cam. A middle of the sliding way is rotatably connected with the cam. Two sides of connection of the sliding way and the cam on the sliding way are provided with a second sliding groove. Each sliding block matches with the first and second sliding grooves, and can slide back and forth along them. The telescopic beams are slidably connected to the spreader body, and are symmetrically provided and connected to the sliding blocks, respectively.

9 Claims, 12 Drawing Sheets

(56) References Cited

U.S. PATENT DOCUMENTS

| | | | | |
|---|---|---|---|---|
| 8,585,108 | B2 * | 11/2013 | Karlsson | B66C 1/102 294/81.53 |
| 8,840,159 | B2 * | 9/2014 | Karlsson | B66C 1/102 294/81.53 |
| 2009/0015025 | A1 * | 1/2009 | Karlsson | B66C 1/102 294/81.4 |
| 2019/0077638 | A1 * | 3/2019 | Karlsson | B66C 6/00 |

FOREIGN PATENT DOCUMENTS

| | | | |
|---|---|---|---|
| CN | 208454263 | U | 2/2019 |
| CN | 111170134 | A | 5/2020 |
| GB | 2216492 | A | 10/1989 |

* cited by examiner

GANTRY CRANE FOR CONTAINER

CROSS-REFERENCE TO RELATED APPLICATIONS

This application claims the benefit of priority from Chinese Patent Application No. 202010501973.9, filed on Jun. 4, 2020. The content of the aforementioned application, including any intervening amendments thereto, is incorporated herein by reference in its entirety.

TECHNICAL FIELD

This application relates to crane machinery, and more particularly to a gantry crane for a container.

BACKGROUND

A container has a large loading capacity and is usually used for cargo turnover and transportation. During use, the cargo is loaded in the container, and then the container is directly hoisted and transported to enable the transportation of the cargo. The hoisting process has nothing to do with shape and performance of the cargo, which improves the hoisting and transportation efficiency of cargo and is thus very important for constructing a multi-turnover logistics system.

Currently, the container has already become a standardized product, and has several standard sizes according to its volume, such as 20 GP: 5898 mm×2352 mm×2393 mm (height), 40 GP: 12032 mm×2352 mm×2393 mm (height) and 40 HC: 12032 mm×2352 mm×2698 mm (height). A special machinery is required to hoist the container with large volume and heavy weight, and a gantry crane is considered a preferable special machinery for the hoisting of containers. During the hoisting process, the spreader needs to be matched with a structure of the container body. However, the clamping part of the spreader in the existing gantry crane has a fixed length, such that the spreader is in one-to-one correspondence to the size of the container. As a result, it is required to replace the crane when the containers to be hoisted are of different sizes, leading to low hoisting efficiency. Therefore, there is an urgent need to develop a universal gantry crane adapting to various sizes of containers, so as to improve the hoisting efficiency.

SUMMARY

An object of this application is to provide a gantry crane for a container, where a spreader assembly of the gantry crane can be extended and contracted to adapt to the containers with different sizes, allowing for enhanced versatility and improved hoisting efficiency.

Technical solutions of this application are described as follows.

This application provides a gantry crane for a container, comprising:

a portal main frame;

a traveling mechanism;

a spreader translation mechanism;

a hoisting mechanism; and a spreader assembly;

wherein the portal main frame comprises a horizontal beam and a support beam; two ends of the horizontal beam are respectively connected to the support beam; and the traveling mechanism is provided at an end of the support beam, and is configured to be able to slide on the ground to move the portal main frame;

the spreader assembly is provided below the spreader translation mechanism; the spreader translation mechanism is connected to the spreader assembly through the hoisting mechanism; the spreader assembly is configured to clamp the container; the hoisting mechanism is configured to lift and lower the spreader assembly to move the container; and the spreader translation mechanism is slidably connected to the horizontal beam to horizontally move the container;

the spreader assembly comprises a spreader body, two telescopic girders and a drive assembly; the spreader body is configured to accommodate the two telescopic girders and the drive assembly; the drive assembly is provided in the spreader body, and comprises a cam, a sliding way and two sliding blocks; two first sliding grooves are provided on the cam along a circumferential direction; the two first sliding grooves each are arc-shaped; two ends of each of the two first sliding grooves are at different distances from a center of the cam, and are defined as a proximal end and a distal end; a middle of the sliding way is rotatably connected with the cam; two sides of a connection point of the sliding way and the cam on the sliding way are respectively provided with a second sliding groove; and each of the two sliding blocks is configured to fit one of the two first sliding grooves and the second sliding groove and to slide back and forth along the one of the two first sliding grooves and the second sliding groove;

the two telescopic girders are slidably connected to the spreader body; the two telescopic girders are symmetrically provided and connected to the two sliding blocks, respectively; an end of each of the two telescopic girders away from the spreader body is provided with a gripper, which is configured to clamp the container; and each of the two sliding blocks slides back and forth along the second sliding groove to drive one of the two telescopic girders to extend and contract along the spreader body to adapt to containers with different sizes.

In an embodiment, the two first sliding grooves are symmetrically provided along the circumferential direction of the cam.

In an embodiment, when the two sliding blocks are located at proximal ends of two first sliding grooves, the distance between the two telescopic girders fits a length of a standard container, and when the two sliding blocks are located at distal ends of the two first sliding grooves, the distance between the two telescopic girders fits another standard container with a different length. When it is required to successively hoist two containers of different sizes with the gantry crane, it is only required to adjust the distance between the two telescopic girders according to the actual need in the unloaded moving process. The adjustment process can be performed by sliding the sliding block to the end of the first sliding groove, reducing the time consumption and improving the hoisting efficiency.

In an embodiment, each of the two telescopic girders comprises two telescopic legs; the two telescopic legs pass through a limit groove on the spreader body and then are connected with each other through a connecting rod; the sliding way is provided with a third sliding groove that penetrates the spreader body; the connecting rod passes through the third sliding groove and is connected to the two sliding blocks; and the two sliding blocks drive the connecting rod to slide back and forth along the third sliding groove.

In an embodiment, each of the two sliding blocks comprises a first accommodating portion and a second accommodating portion; the first accommodating portion is slidably connected to the second sliding groove; two second accommodating portions are slidably connected to the two first sliding grooves, respectively; when the cam is rotated, the two first sliding grooves drive the two second accommodating portions to move, thereby driving the first accommodating portion to slide forth and back along the second sliding groove.

In an embodiment, the first accommodating portion is square and is provided in the second sliding groove; and the two second accommodating portions are cylindrical and are inserted into the two first sliding grooves, respectively.

In an embodiment, a rotating shaft of the cam is connected to a rotor of a servo motor; and the servo motor is configured to control rotation of the cam so as to drive the two telescopic girders to extend and contract to adapt to the containers with different sizes.

In an embodiment, the traveling mechanism is an independent suspension device, comprising a suspension body and wheels provided on both sides of the suspension body. The wheels on both sides of the suspension body are connected independently to the suspension body through a rigid axle, such that when one of the wheels is subjected to an impact and jumps, operation of the rest wheels will not be affected. As a consequence, the gantry crane also has a desirable shock absorption performance.

In an embodiment, a top surface of the suspension body is rotatably connected to a lower end of the support beam, so that the independent suspension device is able to rotate horizontally to change a traveling direction; and the both sides of the suspension body are connected to the wheels by an articulated structure, respectively; the articulated structure comprises two connecting blocks, a support block and an elastic element; the two connecting blocks are provided up and down in parallel; one end of each of the two connecting blocks is hinged with the suspension body, and the other end of each of the two connecting blocks is hinged with the support block; the wheels are rotatably connected to a side of the support block; and one end of the elastic element is hinged with the support block, and the other end of the elastic element is hinged with the suspension body.

Compared to the prior art, this disclosure has the following beneficial effects.

With respect to the gantry crane provided herein for a container, a spreader assembly is provided, in which a cam is provided to drive two telescopic girders to extend and contract by rotation, such that it can be applied to the lifting and transportation of containers with different sizes. As a consequence, the disclosure has a simple structure, easy operation and high hoisting efficiency.

DETAILED DESCRIPTION OF EMBODIMENTS

Figure 1:
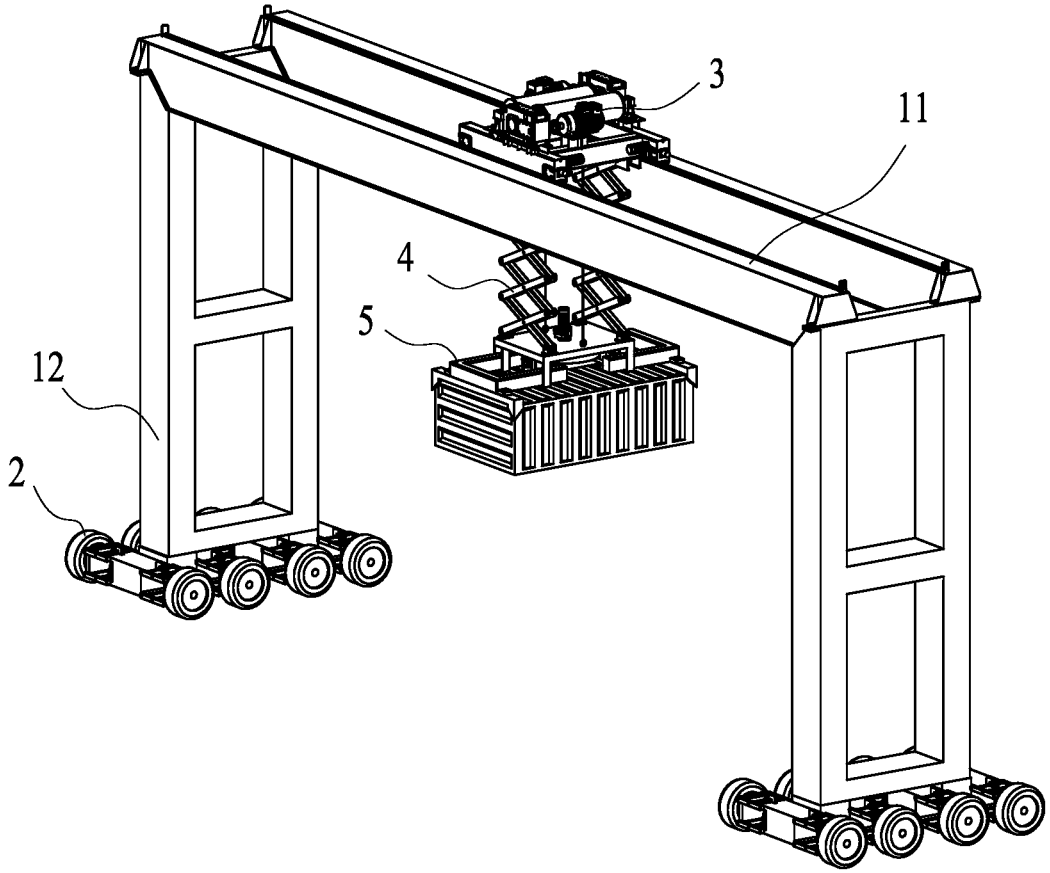
FIG. 1 schematically shows an overall structure of a gantry crane for a container according to Embodiment 1 of the present disclosure.
Figure 2:
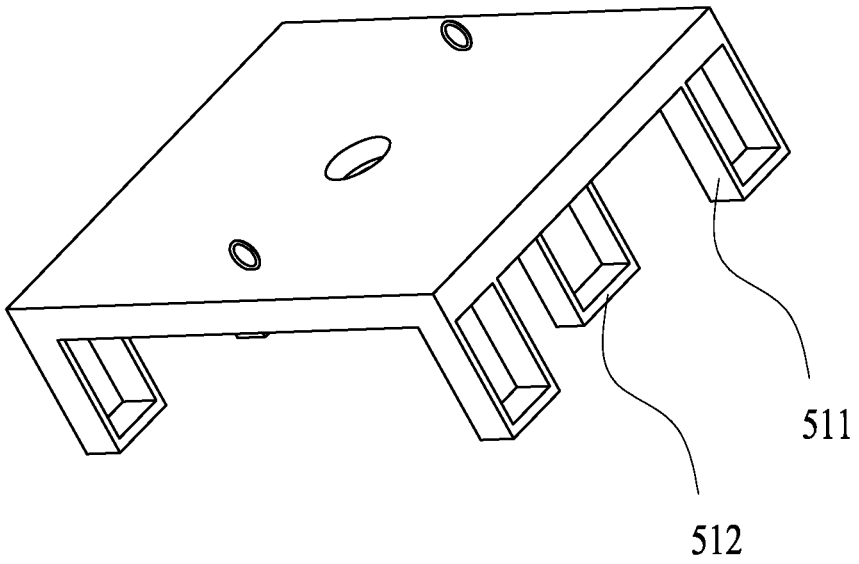
FIG. 2 schematically illustrates a structure of a spreader body according to Embodiment 1 of the present disclosure.
Figure 3:
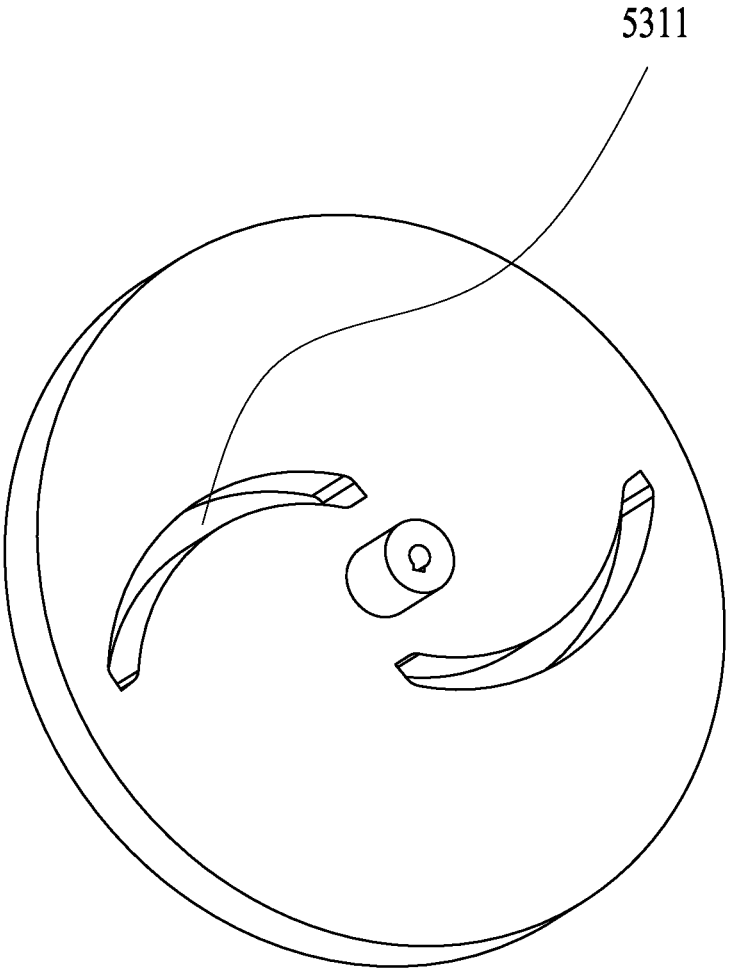
FIG. 3 is a structure diagram of a cam according to Embodiment 1 of the present disclosure.
Figure 4:
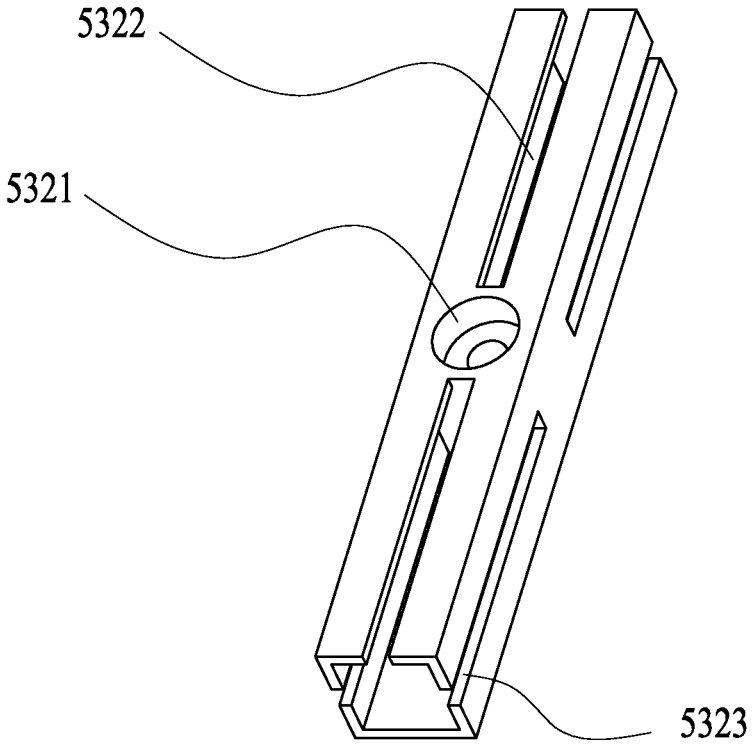
FIG. 4 is a structure diagram of a sliding way according to Embodiment 1 of the present disclosure.
Figure 5:
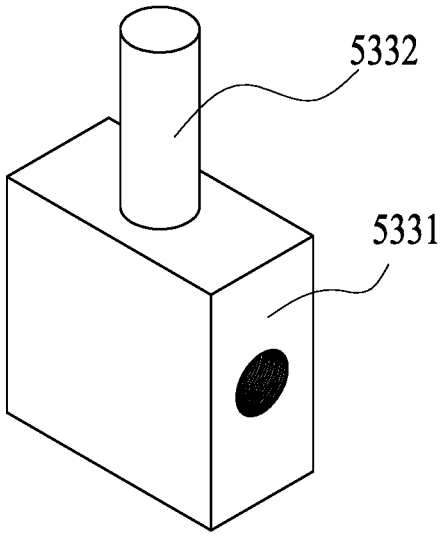
FIG. 5 is a structure diagram of a sliding block according to Embodiment 1 of the present disclosure.
Figure 6:
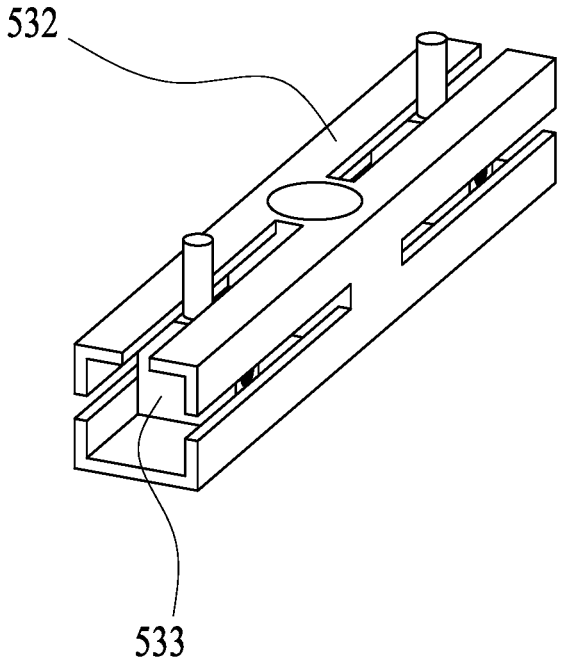
FIG. 6 schematically shows an assembly of the sliding block and the sliding way according to Embodiment 1 of the present disclosure.
Figure 7:
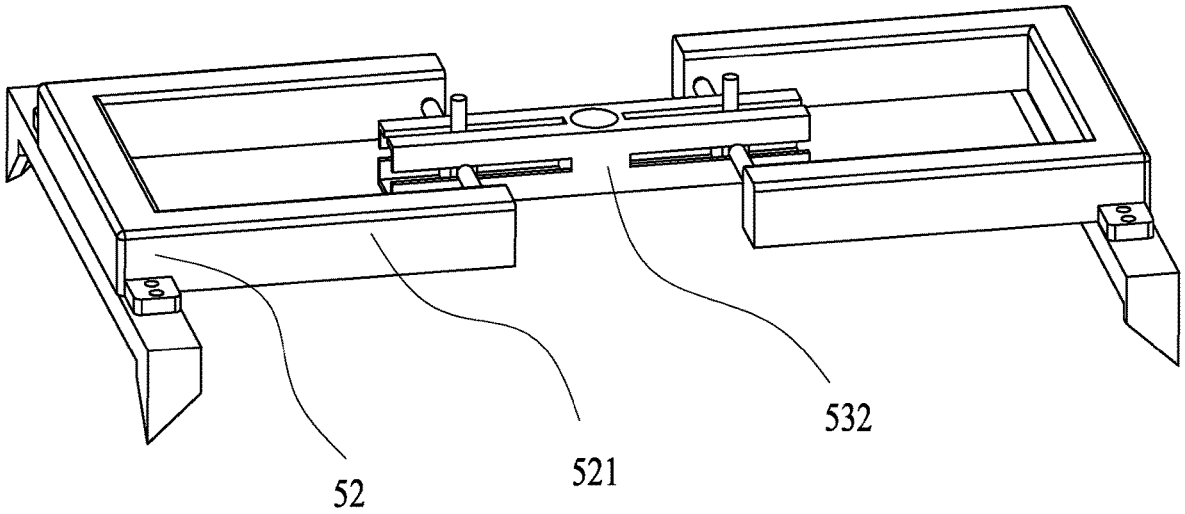
FIG. 7 schematically shows an assembly of the sliding block, the sliding way and a telescopic girder according to Embodiment 1 of the present disclosure.
Figure 8:
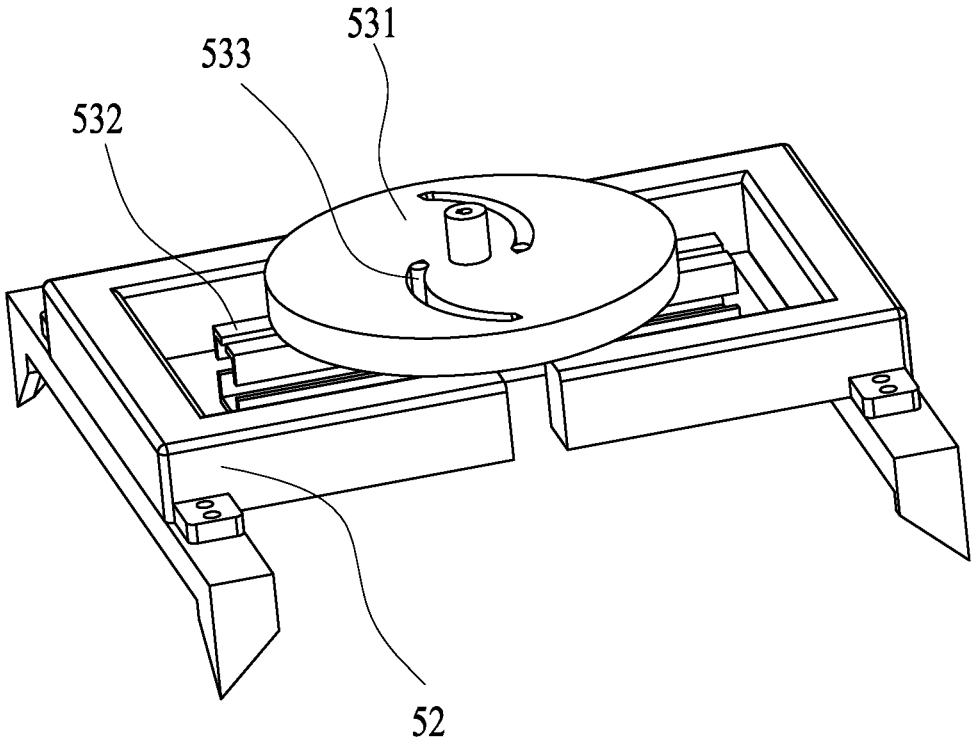
FIG. 8 schematically shows an assembly of the sliding block, the sliding way, the telescopic girder and the cam according to Embodiment 1 of the present disclosure.
Figure 9:
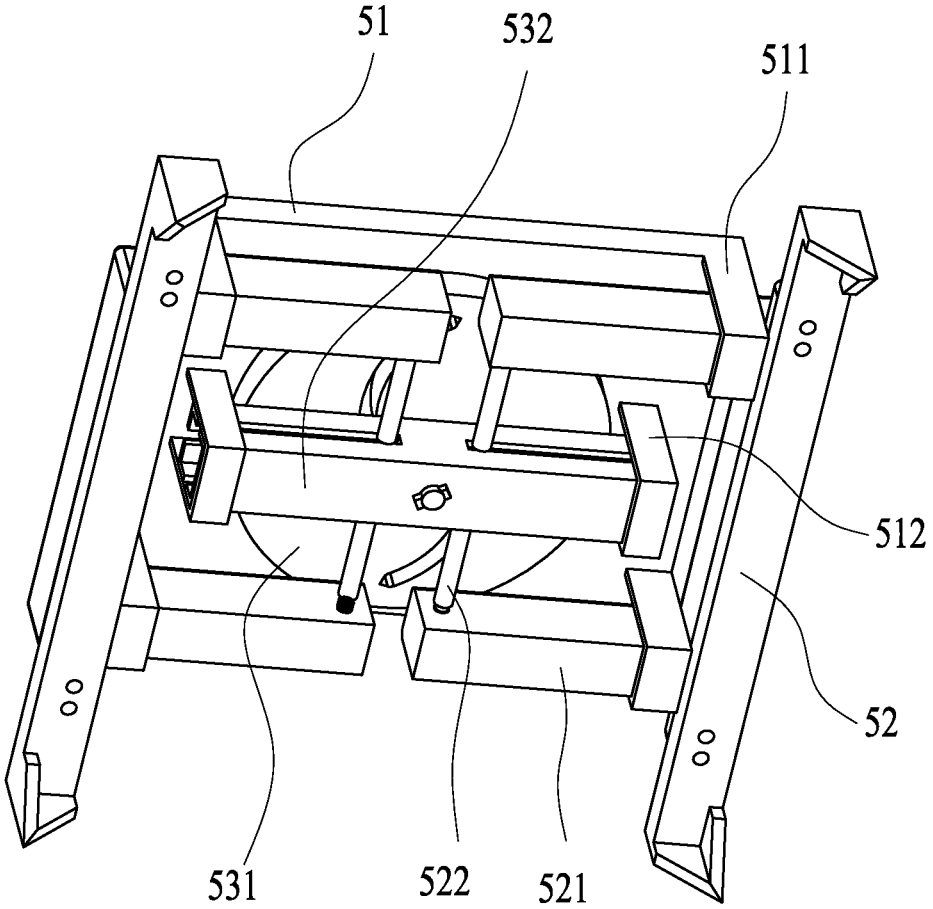
FIG. 9 is a structure diagram of a spreader assembly according to Embodiment 1 of the present disclosure.
Figure 10:
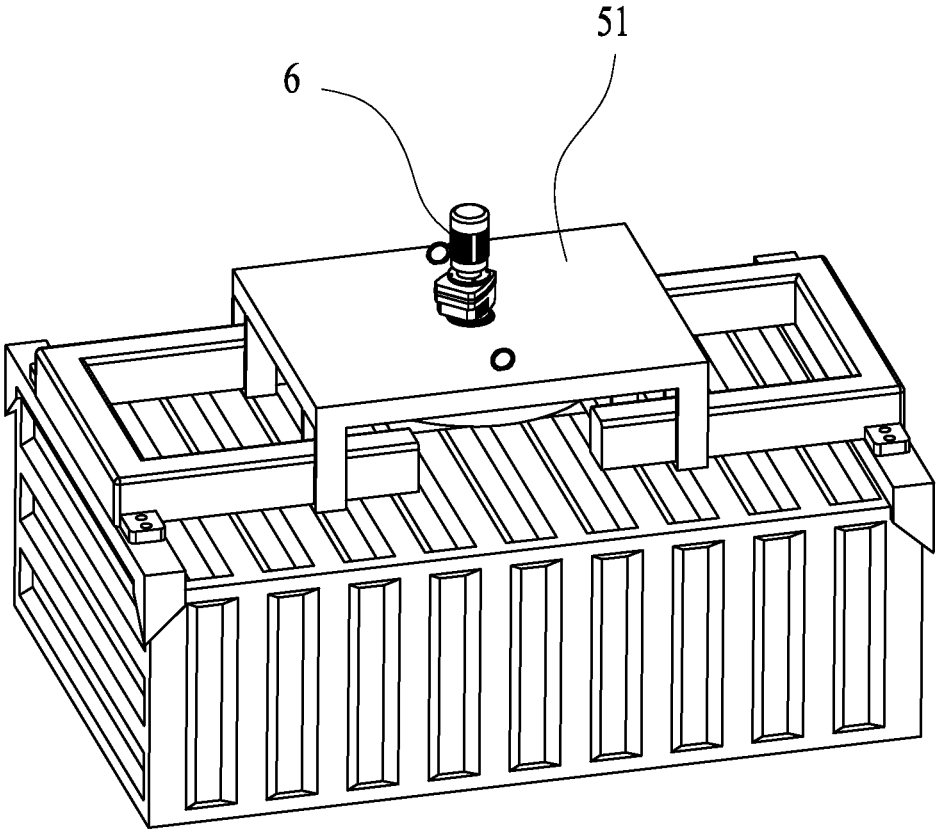
FIG. 10 schematically shows grabbing of the container by the spreader assembly according to Embodiment 1 of the present disclosure.

The present application will be further described in detail below with reference to the embodiments and accompanying drawings.

The embodiments of the present application will be further described in detail below with reference to the accompanying drawings to make the objects, technical solutions and advantages better understood. Obviously, the described embodiments are merely illustrative, and are not intended to limit the scope of the application. Other embodiments made by those of ordinary skill in the art based on the content disclosed herein without sparing any creative effort shall fall within the scope of this application.

It should be noted that similar reference numerals and letters indicate similar items in the accompanying drawings. Once a term has been defined in a figure, it may not be further defined or interpreted in the following figures.

Embodiment 1

Referring to an embodiment shown in FIG. 1, provided is a gantry crane for a container, including a portal main frame, a traveling mechanism 2, a spreader translation mechanism 3, a hoisting mechanism 4 and a spreader assembly 5. The portal main frame includes a horizontal beam 11 and a support beam 12. Two ends of the horizontal beam 11 are respectively connected to the support beam 12, which is configured to support the horizontal beam 11. The traveling mechanism 2 is provided at an end of the support beam 12 and is configured to be able to move the portal main frame. The spreader assembly 5 is provided below the spreader translation mechanism 3. The spreader translation mechanism 3 is slidably connected to the horizontal beam 11 and is connected to the spreader assembly 5 through the hoisting mechanism 4. The spreader assembly 5 is configured to clamp the container. The hoisting mechanism 4 and the spreader translation mechanism 3 are configured to move the spreader assembly 5 vertically and horizontally, respectively, so as to realize the movement of the container.

Referring to an embodiment shown in FIGS. 2-10, the spreader assembly 5 includes a spreader body 51, two telescopic girders 52 and a drive assembly. The spreader body 51 is configured to accommodate the two telescopic girders 52 and the drive assembly. The drive assembly includes a cam 531, a sliding way 532 and two sliding blocks 533. Two first sliding grooves 5311 are provided on the cam 531 along a circumferential direction. The two first sliding grooves 5311 each are arc-shaped. Two ends of each of the two first sliding grooves 5311 are at different distances from a center of the cam 531. A middle of the sliding way 532 is provided with an insertion hole 5321. A rotating shaft at a center of the cam 531 is inserted into the insertion hole 5321 and is rotatably connected to the sliding way 532. Two sides of the insertion hole 5321 on the sliding way 532 are provided with a second sliding groove 5322. Each of the two sliding blocks 533 is configured to fit one of the two first sliding grooves 5311 and the second sliding groove 5322 and to slide back and forth along the one of the two first sliding grooves and the second sliding groove. Specifically, each of the two sliding blocks 533 includes a square portion 5331 in the second sliding groove 5322 and a cylindrical portion 5332 inserted in the first sliding groove 5311. When the cam 531 is rotated, the two first sliding grooves 5311 drive the two cylindrical portions 5332 to rotate, thereby driving the two sliding blocks 533 to move. Since the square portion 5331 is connected to the cylindrical portion 5332 and is limited in the second sliding groove 5322, each of the two sliding blocks 533 can only slide forth and back along the second sliding groove 5322.

The two telescopic girders 52 are symmetrically provided on the spreader body 51. Each of the two telescopic girders 52 includes two telescopic legs 521. The two telescopic legs 521 pass through a limit groove 522 on the spreader body 51 and then are connected with each other through a connecting rod 522. The sliding way 532 is provided with a third sliding groove 5323 that penetrates the spreader body 51. The connecting rod 522 passes through the third sliding groove 5323 and is connected to the two sliding blocks 533. The movement of the two sliding blocks 533 can drive the connecting rod 522 to slide forth and back along the third sliding groove 5323. Two ends of the sliding way 532 are connected to the spreader body 51 by respectively penetrating limit rings 512 of the spreader body 51, so as to prevent the sliding way 532 from shaking. An end of each of the two telescopic girders 52 away from the spreader body 51 is provided with a gripper, which is configured to clamp the container. Each of the two sliding blocks 533 respectively slides back and forth along the second sliding groove 5322 to drive one of the two telescopic girders 52 to extend and contract along the spreader body 51 to adapt to the containers with different sizes. In addition, the spreader body 51 is also fixedly provided with a motor 6. A rotor of the motor 6 is connected to the rotating shaft at the center of the cam 531 and is configured to control the rotation of the cam 531.

Figure 11:
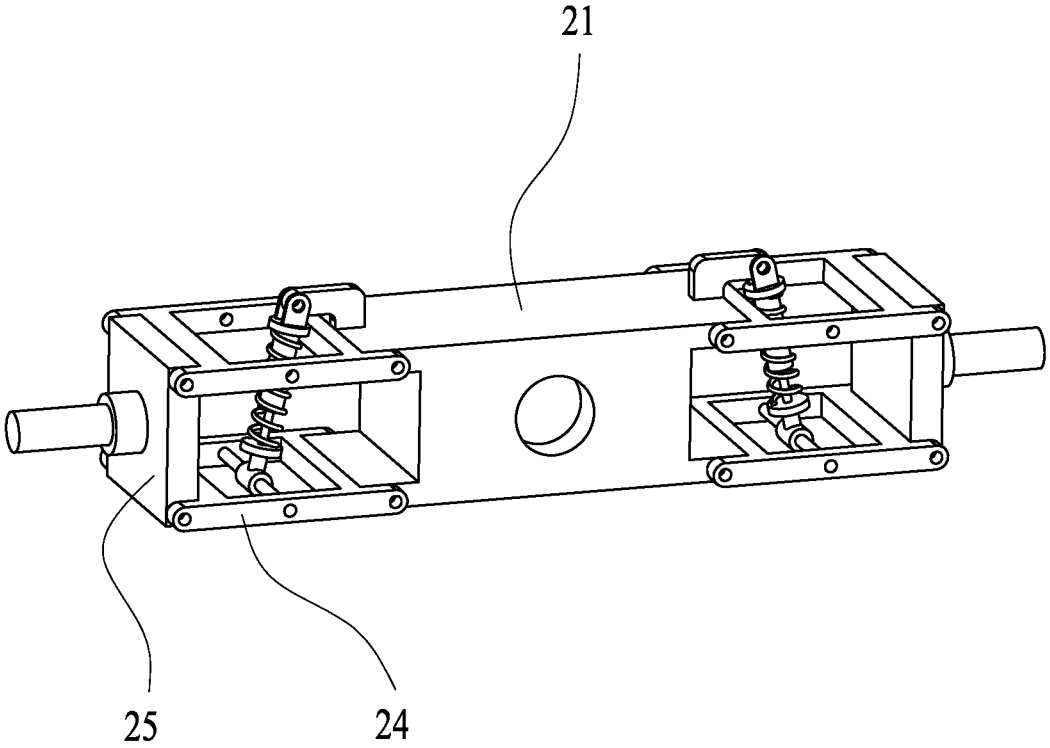
FIG. 11 is a partial structure diagram of a traveling mechanism according to Embodiment 1 of the present disclosure.
Figure 12:
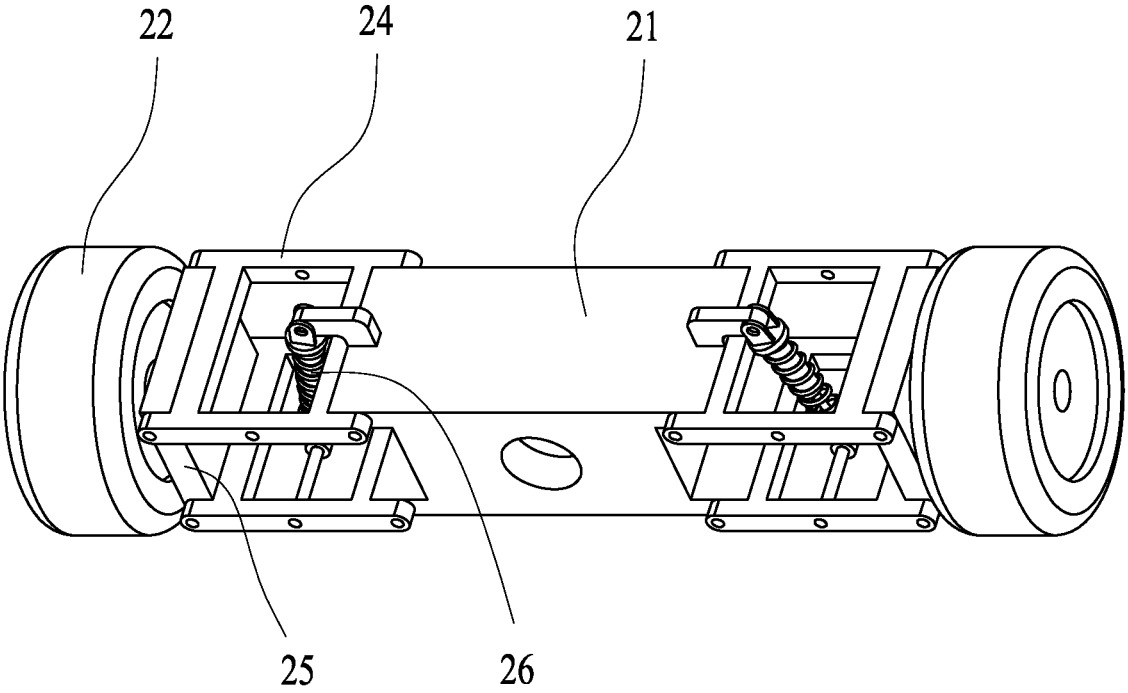
FIG. 12 is an overall structure diagram of the traveling mechanism according to Embodiment 1 of the present disclosure.

Referring to an embodiment shown in FIGS. 11-12, the traveling mechanism 2 is an independent suspension device, including a suspension body 21 and wheels 22 provided on both sides of the suspension body 21. A top surface of the suspension body 21 is rotatably connected to a lower end of the support beam 12, so that the independent suspension device is able to rotate horizontally to change a traveling direction. The both sides of the suspension body 21 are connected to the wheels 22 by an articulated structure. The articulated structure includes two connecting blocks 24, a support block 25 and an elastic element 26. The two connecting blocks 24 are provided up and down in parallel. One end of each of the two connecting blocks 24 is hinged with the suspension body 21, and the other end of each of the two connecting blocks 24 is hinged with the support block 25. The wheels 22 are rotatably connected to a side of the support block 25. One end of the elastic element 26 is hinged with the support block 25, and the other end of the elastic element 26 is hinged with the suspension body 21. Such articulated structure enables the wheels 22 to keep in parallel with a side of the suspension body 21, so that the crane will not tilt even when it encounters uneven places in the moving process.

Embodiment 2

The structure of the gantry crane used herein is the same as that in Embodiment 1, and in the Embodiment 2, the two first sliding grooves 5311 are further limited. When the cylindrical portion 5332 of the sliding block 533 locates at a proximal end or a distal end of the first sliding groove 5311, the distance between the two telescopic girders 52 fits a length of a standard container. Each of the two first sliding grooves 5311 has the proximal end and the distal end. When the sliding blocks 533 are located at the proximal end of the first sliding grooves 5311, the distance between the two telescopic girders 52 fits a length of a standard container, and when the sliding blocks are located at the distal ends of the first sliding grooves 5311, the distance between the two telescopic girders 52 fits another standard container with a different length. When it is required to successively hoist two containers of different sizes with the gantry crane, it is only required to adjust the length between the two telescopic girders 52 according to the actual need in the unloaded moving process. The adjustment process can be performed by sliding the sliding block 533 to the end of the first sliding groove 5311, reducing the time consumption and improving the hoisting efficiency.

As used herein, it should be understood that the terms "up", "down", "front", "back", "left", "right", "top", "bottom", "in", "out" etc. are only used to explain the relative position relationship, movement situation, etc. between the components under a certain attitude (as shown in the attached figure), but are not intended to indicate or imply that the devices or elements must have a specific orientation, configuration and operation. Therefore, these terms cannot be understood as limitations to the application.

The above are only preferred embodiments of this application, and are not intended to limit the scope of this application. Any changes and replacement made by those skilled in the art without departing from the spirit and principle of this application shall fall within the scope of this application defined by the appended claims.

What is claimed is:

1. A gantry crane for a container, comprising:

a portal main frame;

a traveling mechanism;

a spreader translation mechanism;

a hoisting mechanism; and a spreader assembly;

wherein the portal main frame comprises a horizontal beam and a support beam; two ends of the horizontal beam are respectively connected to the support beam; and the traveling mechanism is provided at an end of the support beam, and is configured to move the portal main frame;

the spreader translation mechanism is slidably connected to the horizontal beam and is connected to the spreader assembly through the hoisting mechanism; and the spreader assembly comprises a spreader body, two telescopic girders and a drive assembly; the spreader body is configured to accommodate the two telescopic girders and the drive assembly; the drive assembly is provided in the spreader body; the drive assembly comprises a cam, a sliding way and two sliding blocks;

the cam is provided with two first sliding grooves along a circumferential direction; the two first sliding grooves each are arc-shaped; two ends of each of the two first sliding grooves are at different distances from a center of the cam; a middle of the sliding way is rotatably connected with the cam; two sides of a connection point of the sliding way and the cam on the sliding way are respectively provided with a second sliding groove; each of the two sliding blocks are matched with one of the two first sliding grooves and the second sliding groove and to slide back and forth along the one of the two first sliding grooves and the second sliding groove; the two telescopic girders are slidably connected to the spreader body; and the two telescopic girders are symmetrically provided and connected to the two sliding blocks, respectively.

2. The gantry crane of claim 1, wherein the two first sliding grooves are symmetrically provided along the circumferential direction of the cam.

3. The gantry crane of claim 1, wherein the two sliding blocks are respectively located at ends of two first sliding grooves close to the center of the cam, a distance between the two telescopic girders fits a length of a standard container; and when the two sliding blocks are respectively located at ends of the two first sliding grooves away from the center of the cam, the distance between the two telescopic girders fits another standard container with a different length.

4. The gantry crane of claim 1, wherein each of the two telescopic girders comprises two telescopic legs; the two telescopic legs pass through a limit groove on the spreader body and then are connected with each other through a connecting rod; the sliding way is provided with a third sliding groove that penetrates the spreader body; the connecting rod passes through the third sliding groove and is connected to the two sliding blocks; and the two sliding blocks are configured to drive the connecting rod to slide back and forth along the third sliding groove.

5. The gantry crane of claim 1, wherein each of the two sliding blocks comprises a first accommodating portion and a second accommodating portion; the first accommodating portion is slidably connected to the second sliding groove; two second accommodating portions are slidably connected to the two first sliding grooves, respectively; when the cam is rotated, the two first sliding grooves drive the two second accommodating portions to move, thereby driving the first accommodating portion to slide forth and back along the second sliding groove.

6. The gantry crane of claim 5, wherein the first accommodating portion is square and is provided in the second sliding groove; and the two second accommodating portions are cylindrical and are inserted into the two first sliding grooves, respectively.

7. The gantry crane of claim 1, wherein a rotating shaft of the cam is connected to a rotor of a servo motor; and the servo motor is configured to control rotation of the cam, so as to drive the two telescopic girders to extend and contract to adapt to containers with different sizes.

8. The gantry crane of claim 1, wherein the traveling mechanism is an independent suspension device, comprising a suspension body and wheels provided on both sides of the suspension body.

9. The gantry crane of claim 8, wherein a top surface of the suspension body is rotatably connected to a lower end of a support beam; and the both sides of the suspension body are connected to the wheels by an articulated structure, respectively; and the articulated structure comprises two connecting blocks, a support block and an elastic element; the two connecting blocks are provided up and down in parallel; one end of each of the two connecting blocks is hinged with the suspension body, and the other end of each of the two connecting blocks is hinged with the support block; the wheels are rotatably connected to a side of the support block; and one end of the elastic element is hinged with the support block, and the other end of the elastic element is hinged with the suspension body.

* * * * *